US007373715B2

(12) United States Patent
Hirai et al.

(10) Patent No.: US 7,373,715 B2
(45) Date of Patent: May 20, 2008

(54) METHOD OF ADJUSTING A CHARACTERISTIC OF WIRE-WOUND TYPE CHIP COIL BY ADJUSTING THE SPACE BETWEEN CONDUCTIVE WIRES

(75) Inventors: Shinya Hirai, Sagamihara (JP); Takaomi Toi, Machida (JP); Katsuhiko Tsubana, Miyagi-ken (JP); Hiroyuki Yasuzawa, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 162 days.

(21) Appl. No.: 11/062,270

(22) Filed: Feb. 18, 2005

(65) Prior Publication Data

US 2005/0146409 A1 Jul. 7, 2005

Related U.S. Application Data

(62) Division of application No. 10/215,083, filed on Aug. 9, 2002, now abandoned.

(30) Foreign Application Priority Data

Aug. 9, 2001 (JP) ..... 2001-242692
Jun. 27, 2002 (JP) ..... 2002-188441

(51) Int. Cl.
*H01F 7/06* (2006.01)

(52) U.S. Cl. ..... 29/606; 29/602.1; 29/605; 29/608; 264/250; 264/272.19; 336/83; 336/175; 336/192; 336/200; 336/212; 336/233

(58) Field of Classification Search ..... 29/602.1, 29/605, 606, 608; 264/250, 272.19; 336/83, 336/175, 192, 200, 212, 233
See application file for complete search history.

(56) References Cited

U.S. PATENT DOCUMENTS 4,269,235 A * 5/1981 Muskulus ..... 140/92.1
5,692,290 A * 12/1997 Mamada et al. ..... 29/605
5,739,738 A * 4/1998 Hansen et al. ..... 336/229

(Continued)

FOREIGN PATENT DOCUMENTS

JP 49-121044 11/1974

(Continued)

OTHER PUBLICATIONS

"Inductance calculation of a coil gun that launches a thin plate edge-on"; Hummer, C.R.; Berning, P.R.; Hollandsworth, C.E.; Pulsed Power Conference, 1997. Digest of Technical Papers. 1997 11th IEEE International vol. 2; Jun. 29-Jul. 2, 1997; pp. 1156-1161, vol. 2.*

(Continued)

*Primary Examiner*—Paul D. Kim
(74) *Attorney, Agent, or Firm*—Keating & Bennett, LLP

(57) ABSTRACT

A wire-wound type chip coil can take various inductance values while maintaining its outer dimension at a specified fixed value. A chip coil is formed by winding at least two conductive wires regularly in a single layer around a core made of a magnetic material and firmly connecting both ends of each conductive wire to terminal electrodes disposed on respective flanges of the core. This makes it possible to obtain a great current capacity. Furthermore, the inductance decreases because of an increase in the magnetic path length. A great number of different inductance values can be easily obtained by properly selecting parameters including the number of substantially parallel conductive wires, the diameter of each conductive wire, and the number of turns.

10 Claims, 11 Drawing Sheets

U.S. PATENT DOCUMENTS

| | | | | |
|---|---|---|---|---|
| 6,072,992 | A * | 6/2000 | Mishima et al. | 455/76 |
| 6,373,366 | B1 * | 4/2002 | Sato et al. | 336/192 |
| 6,472,969 | B1 | 10/2002 | Hanato | |
| 6,522,230 | B2 | 2/2003 | Hanato et al. | |
| 6,535,095 | B2 | 3/2003 | Aoki et al. | |
| 6,552,642 | B1 | 4/2003 | Toi et al. | |
| 7,196,608 | B2 * | 3/2007 | Hirai et al. | 336/200 |

FOREIGN PATENT DOCUMENTS

| | | |
|---|---|---|
| JP | 07-272937 | 10/1995 |
| JP | 08-186034 | 7/1996 |
| JP | 09-63850 | 3/1997 |
| JP | 11-97274 | 4/1999 |
| JP | 11-340059 | 12/1999 |
| JP | 2000-58343 | 2/2000 |
| JP | 2001-38343 | 3/2001 |

OTHER PUBLICATIONS

Official Communication issued in the corresponding Japanese Application No. 2002-188441, dated Aug. 29, 2005. (with full English translation).

Shinya Hirai. U.S. Appl. No. 11/062,270, filed Feb. 18, 2005, "Wire-Wound Type Chip Coil and Method of Adjusting a Characteristic Thereof."

* cited by examiner

Fig. 11

| | E12 | 1.0 | | 1.2 | | 1.5 | | 1.8 | | 2.2 | | 2.7 |
|---|---|---|---|---|---|---|---|---|---|---|---|---|
| | E24 | 1.0 | 1.1 | 1.2 | 1.3 | 1.5 | 1.6 | 1.8 | 2.0 | 2.2 | 2.4 | 2.7 |
| Prior Art ---→ | | | | | | 1T=1.5 | | | | | | 2T=2.7 |
| 1st Embodiment ---→ | | | | 1T=1.2 | | | | | | | 2T=2.4 | |
| 2nd Embodiment ---→ | | | 1T=1.1~1.3 | | | | | 2T=1.8~2.4 | | | | |
| 3rd Embodiment ---→ | | | | | | | | | 2T=2.0~2.4 | | | |

METHOD OF ADJUSTING A CHARACTERISTIC OF WIRE-WOUND TYPE CHIP COIL BY ADJUSTING THE SPACE BETWEEN CONDUCTIVE WIRES

This application is a Divisional Application of U.S. patent application Ser. No. 10/215,083 filed Aug. 9, 2002, now abandoned.

BACKGROUND OF THE INVENTION

1. Field of the Invention

The present invention relates to a wire-wound type chip coil and in particular, a small-sized wire-wound type chip coil for use, for example, in a high-frequency circuit, and also to a method of adjusting a characteristic of a wire-wound type chip coil.

2. Description of the Related Art

The structure of a conventional wire-wound type chip coil is described below with reference to FIG. 12.

FIG. 12 is a perspective view illustrating the external appearance of a wire-wound type chip coil according to a conventional technique.

In FIG. 12, reference numeral 100 denotes a chip coil, 1 denotes a core, 11 denotes flanges, 2 denotes a conductive wire, 21 denotes end portions of the conductive wire, 3 denotes terminal electrodes, and 4 denotes a coating resin.

The chip coil 100 is produced by winding one conductive wire 2 around the core 1 made of a magnetic material, and firmly connecting the two ends 21 of the conductive wire 2 to the respective terminal electrodes 3 disposed on the flanges 11 of the core 1.

The conventional wire-wound type chip coil has problems to be solved, as described below.

In recent high-frequency circuits, a very difficult process is needed to adjust the matching between a circuit element and a transmission line. To make the adjustment, it is necessary to prepare coils having a large number of different values of inductance within a small range (less than about 10 nH).

However, in conventional wire-wound type chip coils having a structure such as that described above, only integers are allowed for the number of turns of a winding connected between electrodes, and inductance is limited to corresponding values.

Specific examples of inductance values that a 1005-size (1.0 mm×0.5 mm in bottom surface size) of a wire-wound type chip coil can take are discussed below. In FIG. 11, examples of inductance values that this conventional wire-wound type chip coil can take are shown. (Note that examples of inductance values that wire-wound type chip coil according to preferred embodiments of the present invention are also shown in FIG. 11.) For example, when one conductive wire with a diameter of 50 μm is wound around a 1005-size core, only discrete inductance values such as 1.5 nH for a one-turn coil, 2.7 nH for a two-turn coil, and so on, can be obtained. Thus, values lower than 1.5 nH and values of 1.8 nH and 2.2 nH in the E12 series, and values lower than 1.5 nH and values of 1.6, 1.8, 2.0, 2.2, and 2.4 nH in the E24 series cannot be obtained.

Similarly, in a case in which a wire-wound type chip coil is formed by winding a conductive wire with a diameter of 80 μm around a 1608-size (1.6 mm×0.8 mm in bottom face size), only discrete values such as 2.2 nH for a one-turn coil, 2.7 nH for a two-turn coil, and so on can be obtained.

Thus, in this technique, available inductance is limited to special values, as long as an identical conductive wire is used. That is, in the specific example described above, inductance values lower than 2.2 nH and values between 2.2 nH and 2.7 nH cannot be obtained.

SUMMARY OF THE INVENTION

In order to overcome the problems described above, preferred embodiments of the present invention provide a wire-wound type chip coil which can have a large number of different inductance values while maintaining its outer dimensions at the same specified value. In addition, preferred embodiments of the present invention provide a method of adjusting a characteristic of such a wire-wound type chip coil.

According to a preferred embodiment of the present invention, a wire-wound type chip coil includes at least two conductive wires so as to obtain an inductance value that is different from that obtainable by using one conductive wire.

In this wire-wound type chip coil according to preferred embodiments of the present invention, the two or more wires may be wound regularly in a single layer and substantially parallel around a core such that the resultant wire-wound type chip coil has a simple structure.

In this wire-wound type chip coil according to preferred embodiments of the present invention, the two or more conductive wires may be twisted together to form a single strand, and the strand of twisted wires may be wound around the core. This makes it possible to obtain a further different inductance value.

In this wire-wound type chip coil according to preferred embodiments of the present invention, the two or more conductive wires may be wound around the core such that the two or more conductive wires are spaced from each other and electrically parallel to other. This makes it possible to obtain an inductance value which is different from that obtainable by using one conductive wire and also different from that obtainable by the single-layer regular-winding structure.

According to another preferred embodiment of the present invention, a method of adjusting a characteristic of a wire-wound type chip coil including a core, flanges having a terminal electrode and disposed on both ends of the core, a conductive wire wound around the core, two ends of the conductive wire being electrically connected to the respective terminal electrodes in parallel, wherein the method includes adjusting the space between adjacent wires wound around the core so as to adjust the inductance between the terminal electrodes.

Other features, elements, characteristics, steps and advantages of the present invention will become more apparent from the following detailed description of preferred embodiments thereof with reference to the attached drawings.

BRIEF DESCRIPTION OF THE DRAWINGS

FIG. 11 is a table showing examples of inductance values that wire-wound type chip coils can take.

DETAILED DESCRIPTION OF PREFERRED EMBODIMENTS

A wire-wound type chip coil according to a first preferred embodiment of the present invention is described below with reference to FIGS. 1 to 5.

Figure 1:
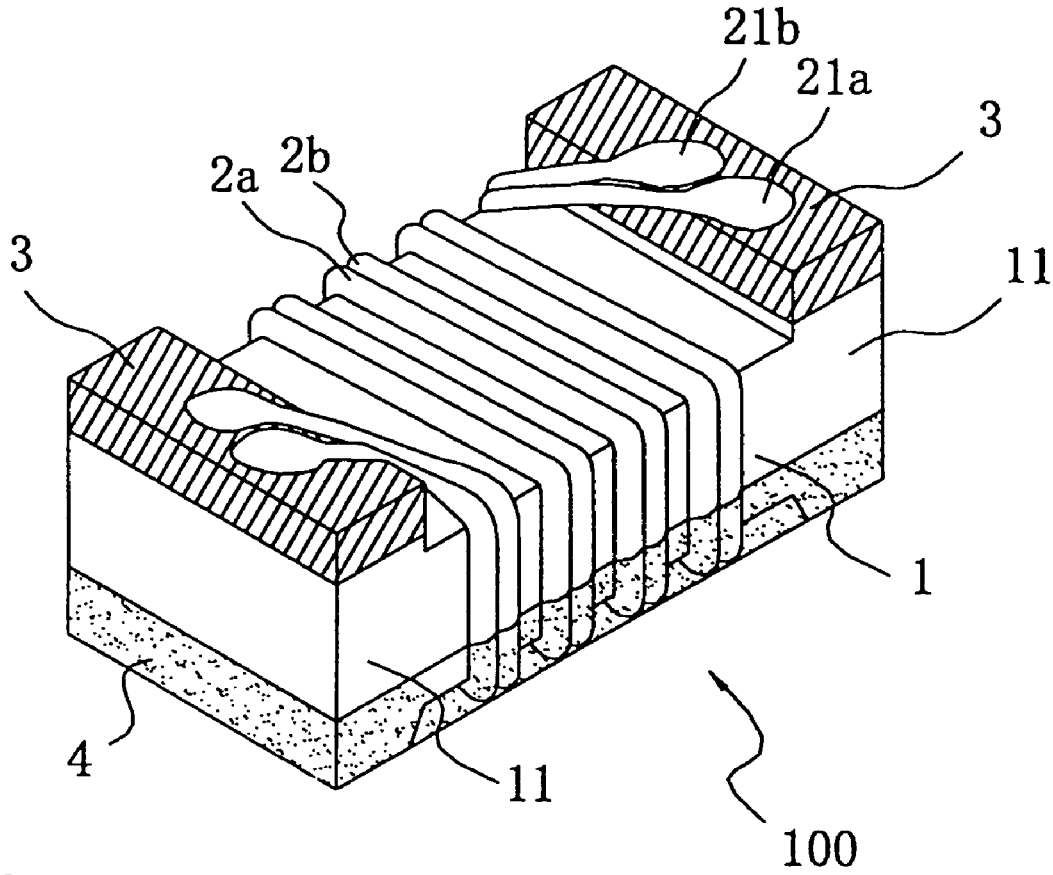
FIG. 1 is a perspective view illustrating the external appearance of a wire-wound type chip coil according to a first preferred embodiment of the present invention.
Figure 2:
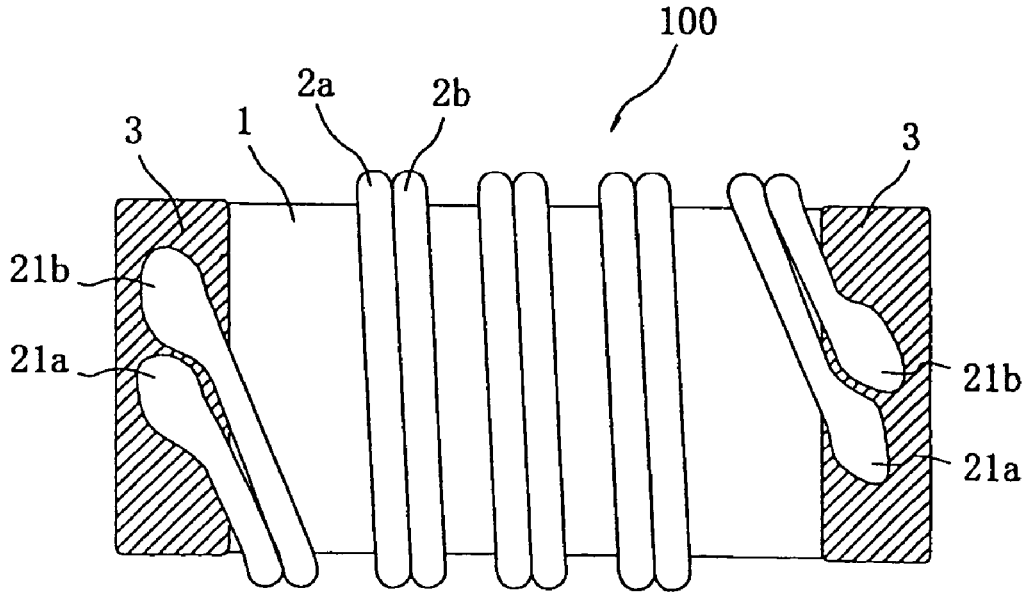
FIG. 2 is a bottom plan view of the wire-wound type chip coil of FIG. 1.

FIG. 1 is a perspective view illustrating the external appearance of the wire-wound type chip coil, and FIG. 2 is a bottom plan view thereof. In FIGS. 1 and 2, reference numeral 1 denotes a core having flanges 11 respectively disposed on both ends, 2*a* and 2*b* denote conductive wires wound around the core 1, 21*a* and 21*b* denote end portions of the conductive wires, 3 denotes a terminal electrode disposed on the end of each flange 11, 4 denotes a coating resin disposed on one principal surface of the core 1 around which the conductive wires 2*a* and 2*b* are wound, and 100 denotes a chip coil.

A method of forming the chip coil 100 is described below with reference to FIGS. 3 to 5.

Figure 3A:
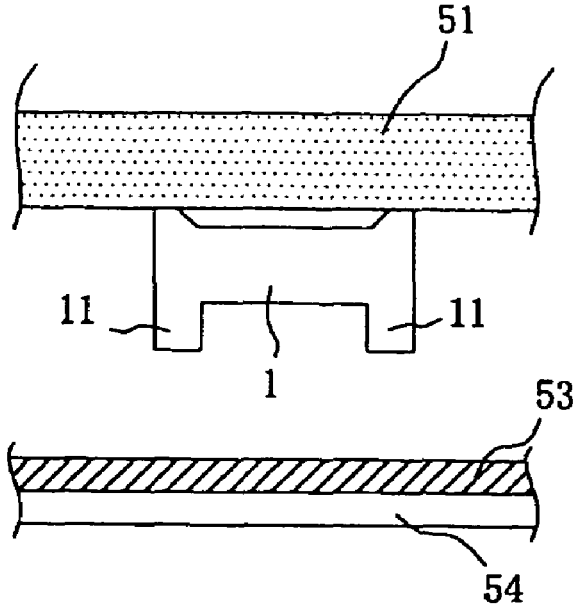
FIG. 3 is a diagram showing a process of forming an electrode by means of coating according to a preferred embodiment of the present invention.
Figure 3B:
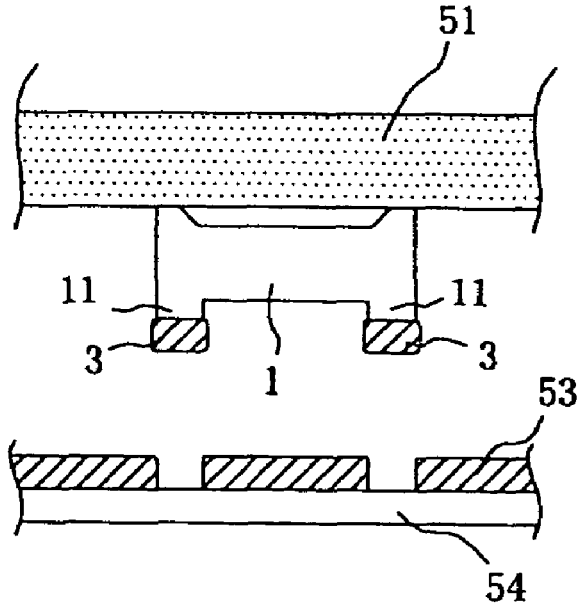

FIGS. 3A and 3B are diagrams showing a process of forming the terminal electrodes 3 by means of coating, wherein FIG. 3A shows a structure in a state in which coating is not performed yet, and FIG. 3B shows a structure in a state in which coating has been performed.

In FIG. 3, reference numeral 51 denotes a holder for holding the core 1, 53 denotes a conductive paste containing Ag or other suitable material, and 54 denotes a platen.

Figure 4:
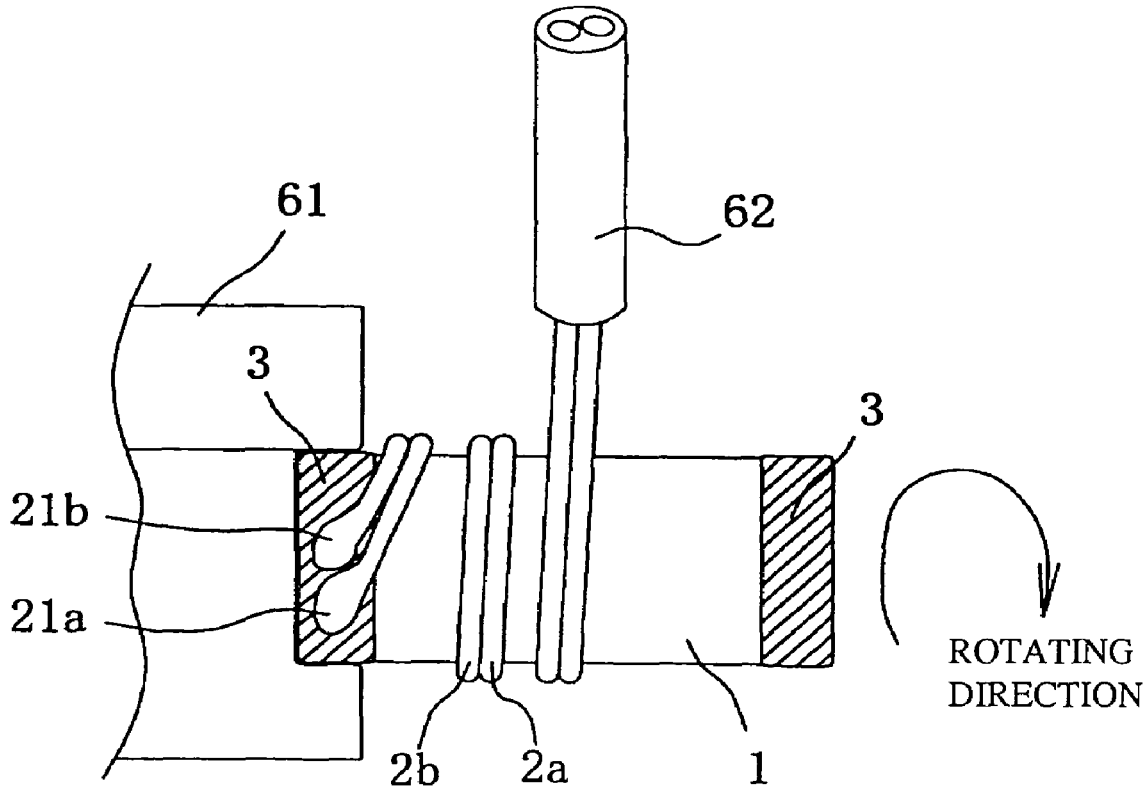
FIG. 4 is a diagram showing a process of winding conductive wires around a core according to a preferred embodiment of the present invention.

FIG. 4 is a diagram showing a process of winding the conductive wires 2*a* and 2*b* around the core 1. In FIG. 4, reference numeral 61 denotes a chuck for holding one end of the core 1 and rotating it in a predetermined direction, and 62 denotes a winding nozzle.

Figure 5A:
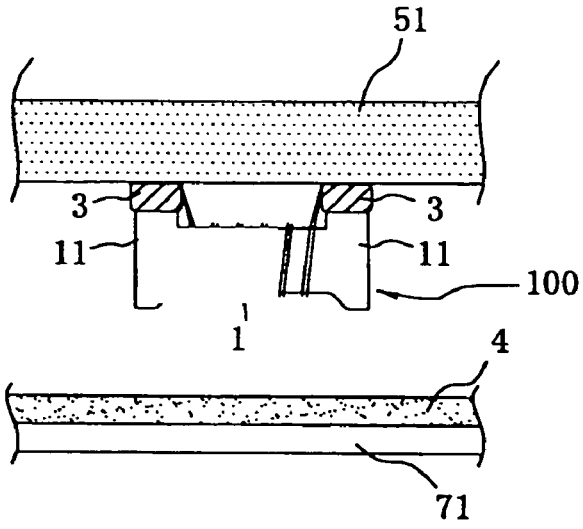
FIG. 5 is a diagram showing a process of coating a resin according to a preferred embodiment of the present invention.
Figure 5B:
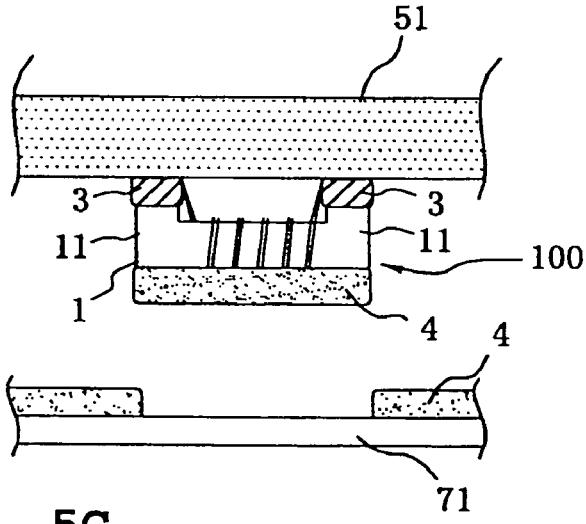
Figure 5C:
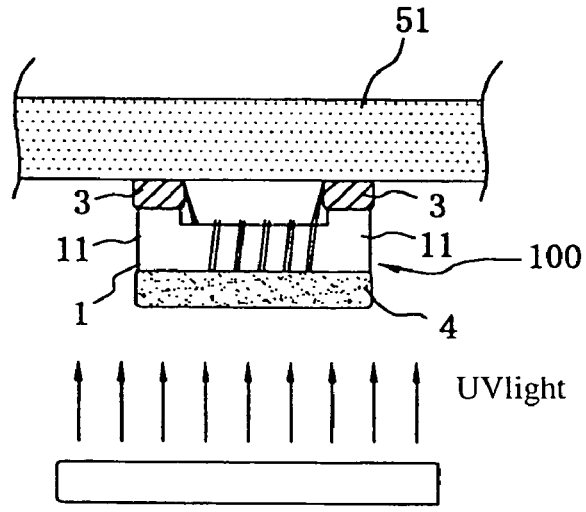

FIGS. 5A to 5C are diagrams showing a process of forming the coating resin 4 on one principal surface of the core 1 around which the conductive wires have been wound, while holding the core 1 by a holder 51, wherein FIG. 5A shows a state in which the resin 4 is not coated yet, FIG. 5B shows a state in which the resin 4 has been coated, and FIG. 5C shows a state in which the resin 4 is being irradiated with UV light.

In FIG. 5, reference numeral 71 denotes a platen.

The core 1 is preferably formed of a material having a relative magnetic permeability of about 1, such as alumina, by means of press molding or other suitable process, such that the core 1 includes a portion around which the conductive wires 2*a* and 2*b* are to be wound and also includes flanges 11 respectively disposed on both ends.

The terminal electrode 3 is formed on the end of each flange 11 of the core 1 preferably by applying a conductive paste using a dipping or printing process. The terminal electrodes 3 are formed such that the terminal electrodes 3 have a thickness of about 10 μm to about 30 μm after the conductive paste is dried and baked.

In a case in which the electrodes are formed by dipping, the core 1 is held by the holder 51 such that the other principal surface of the core 1 faces down, that is, such that the ends of the respective flanges 11 face down, as shown in FIG. 3. On the other hand, a conductive paste 53 is coated on the platen 54 such that the coated conductive paste 53 has a thickness (for example, about 0.5 mm to about 1.0 mm) that is less than the height of the protruding flanges 11. The holder 51 is then moved downward until the flanges 11 of the core 1 come into contact with the platen 54 thereby dipping the flanges 11 in the conductive paste 53. As a result, the conductive paste is coated on the bottom surface of each flange 11 and also four adjacent side surfaces. Thereafter, pulling-up, drying, and baking are performed, thereby forming the terminal electrodes 3.

After forming the terminal electrodes 3 on the flanges 11 of the core 1, one end of the core 1 is held by the chuck 61 as shown in FIG. 4, the ends 21*a* and 21*b* of the two substantially parallel conductive wires 2*a* and 2*b* extracted from the winding nozzle 62 are simultaneously connected securely to one terminal electrode. Although the conductive wires 2*a* and 2*b* are covered with an insulating coating, when heat is applied in order to connect the conductive wires 2*a* and 2*b* to the one terminal electrode, the insulating coating is partially removed such that the end portions of the respective conductive wires 2*a* and 2*b* are exposed.

The two conductive wires 2*a* and 2*b* are then wound around the core 1, as shown in FIG. 4, preferably via a spindle method. More specifically, the core 1 is rotated so that the conductive wires extracted from the fixed winding nozzle 62 are wound around the core 1. In this process, the chuck 61 rotates about a rotation axis extending in a longitudinal direction of the core 1 while moving a small distance in the longitudinal direction so that the two conductive wires 2*a* and 2*b* extracted from the winding nozzle 62 disposed at a fixed location are wound substantially parallel and regularly around the core 1 a predetermined number of turns.

After the two conductive wires 2*a* and 2*b* have been wound the predetermined number of turns, the conductive wires 2*a* and 2*b* are simultaneously connected securely to the other terminal electrode in a similar manner as described above, and the remaining portions of the conductive wires 2*a* and 2*b* are cut off. The diameters of the respective conductive wires 2*a* and 2*b* are preferably selected to be within the range of about 20 μm to about 120 μm depending on the size of the core 1 and the number of turns determined so as to obtain desired inductance. The diameters of the respective conductive wires 2*a* and 2*b* may be different from each other. As for the material of the conductive wires 2*a* and 2*b*, a magnet wire of Cu or Cu alloy may be preferably used. As for the material of the insulating coating, a polyurethane- or polyester-based material may preferably be used.

Although the core 1 with the wound conductive wires 2*a* and 2*b* obtained at this stage may be used as a chip coil, one principal surface of the core 1 is preferably covered with a coating resin to protect the conductive wires and to make it possible to easily handle the coil chip.

As shown in FIG. 5, the chip coil 100 is held by the holder 51 via the bottom surfaces of the terminal electrodes such that the upper surface of the chip coil 100 faces down (FIG. 5A). On the other hand, a UV-curable resin paste 4 or other suitable material used as the material of the coating resin is coated on the platen 71 to have a predetermined thickness. The chip coil 100 with the upper surface being facing the resin paste 4 is dipped into the resin paste 4 to a predetermined depth. The chip coil 100 is then pulled up (FIG. 5B). Thereafter, the resin paste 4 coated on the chip coil is irradiated with UV light thereby curing the resin paste 4. Preferably, the thickness of the coating resin is greater than the height of the flanges 11 protruding from the upper surface of the chip coil. For example, if the height of the protruding flanges is equal to about 0.1 mm, the proper thickness of the coating resin is about 0.15 mm to about 0.3 mm. Except for the electrodes 3, the entire surface of the chip coil may be covered with the coating resin.

By winding two conductive wires substantially parallel and regularly in a single layer in the above-described manner, it is possible to obtain a greater current capacity than can be obtained by a single conductive wire. Furthermore, the inductance decreases because of an increase in the magnetic path length.

In the table shown in FIG. 11, values of inductance obtained by winding two conductive wires with a diameter of about 50 μm regularly in a single layer around a 1005-size core are shown in a row denoted by "FIRST EMBODIMENT". In this case, in contrast to the "CONVENTIONAL TECHNIQUE" in which 1.5 nH and 2.7 nH are obtained respectively for one-turn and two-turn coils of one conductive wire, use of two conductive wires results in reductions in inductance down to about 1.2 nH and about 2.4 nH for one-turn and two-turn coils respectively.

As described earlier, when a single conductive wire with a diameter of about 80 μm is wound one turn around a 1608-size core, resultant inductance is about 2.2 nH. Herein, if the single conductive wire is replaced with two conductive wires, the inductance decreases to about 1.8 nH. If the number of substantially parallel conductive wires is further increased, a further reduction in inductance is achieved. Thus, by properly selecting the number of substantially parallel conductive wires and the number of turns, it is possible to easily obtain various inductance values that cannot be achieved by the conventional technique without having to change the outside dimension of the chip coil.

Furthermore, use of two conductive wires wound substantially parallel results in a reduction in the resistance of the coil, and thus, a coil having a high Q value can be achieved. This allows a great reduction in loss of a matching circuit.

In a case in which two conductive wires are twisted together into the form of a single strand, the inductance also becomes lower than the inductance obtainable by a single conductive wire. This makes it possible to obtain further greater number of different values of inductance.

A wire-wound type chip coil according to a second preferred embodiment is described below with reference to FIGS. 6 and 7.

Figure 6:
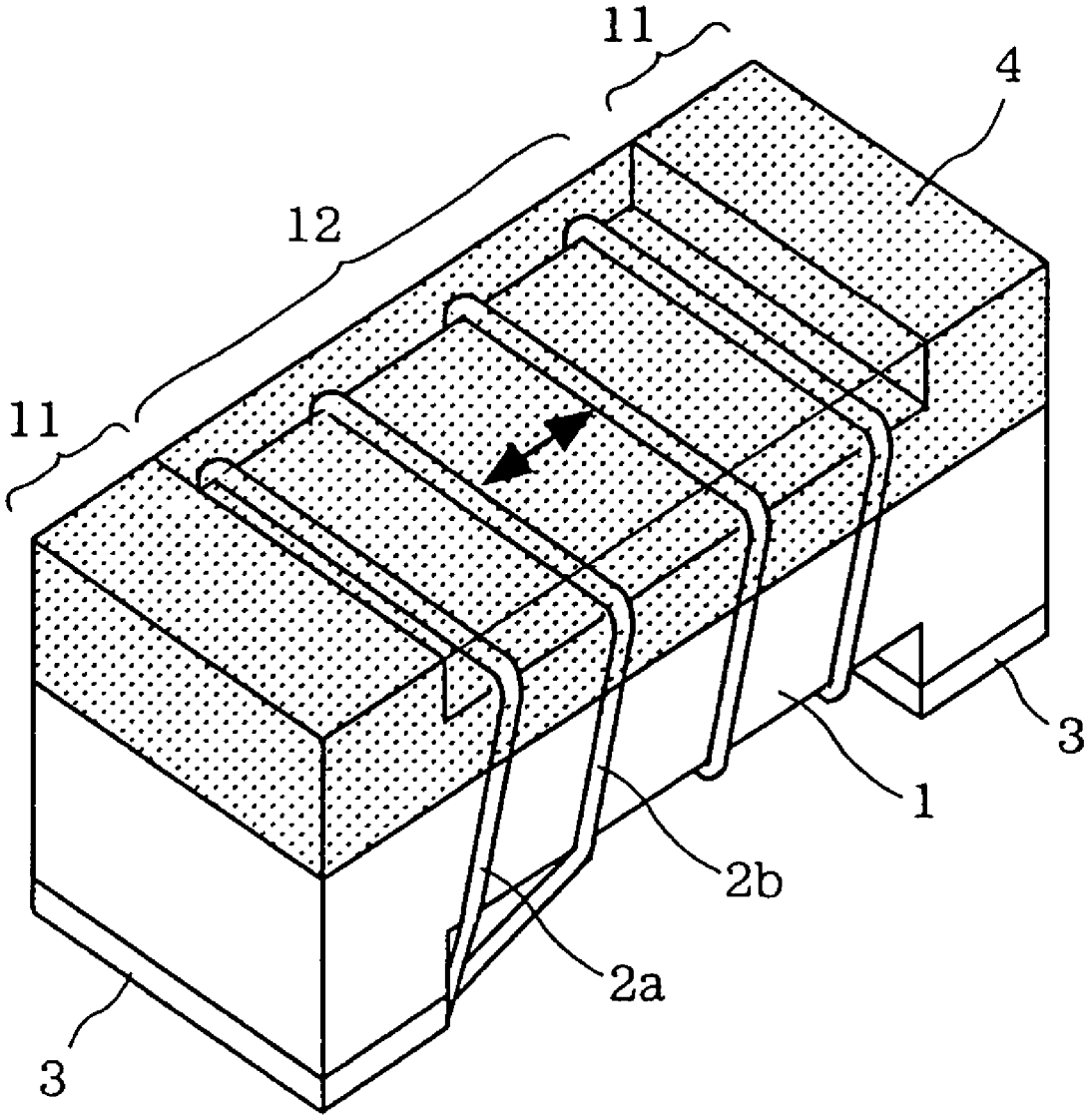
FIG. 6 is a perspective view illustrating the external appearance of a wire-wound type chip coil according to a second preferred embodiment of the present invention.

FIG. 6 is a perspective view illustrating the external appearance of the wire-wound type chip coil. In FIG. 6, unlike FIG. 1 in which the chip coil is drawn such that the surface on which the terminal electrodes 3 are disposed faces up, the chip coil is drawn such that the surface on which terminal electrodes 3 are disposed faces down. In FIG. 6, reference numeral 1 denotes a core, 11 denotes a flange disposed on each end of the core, 12 denotes a main portion of the core, and 2*a* and 2*b* denote conductive wires wound around the main portion 12 of the core. The two ends of each of the two conductive wires 2*a* and 2*b* are connected to terminal electrodes 3 in a similar manner as in the first preferred embodiment of the present invention. Reference numeral 4 denotes a coating resin disposed on one principal surface of the core 1 around which the conductive wires 2*a* and 2*b* are wound.

In this wire-wound type chip coil according to the second preferred embodiment, the conductive wires 2*a* and 2*b* are wound around the main portion 12 of the core 1 such that the conductive wires 2*a* and 2*b* are spaced from each other and such that the distance between any adjacent wires becomes substantially equal. In the table shown in FIG. 11, in a row denoted by "SECOND EMBODIMENT", shown are values of inductance obtained by winding two conductive wires with a diameter of about 50 μm around a 1005-size core such that the conductive wires are spaced from each other and such that the distance between any adjacent wires becomes substantially equal. As can be seen, an inductance of about 1.1 nH to about 1.3 nH is obtained by a one-turn coil of two wires, and inductance of about 1.8 nH to about 2.4 nH is obtained by a two-turn coil.

Thus, inductance of about 2.4 nH for a two-turn regularly-wound single-layer coil can be reduced to about 1.8 nH by expanding the space between the two conductive wires. In the case of a one-turn coil, inductance of about 1.2 nH for a regularly-wound coil can be reduced to about 1.1 nH by expanding the space between the two conductive wires. This makes it possible to achieve low inductance values in the E12 series or E24 series, which cannot be achieved by the conventional technique unless the size of the coil component is changed.

Figure 7:
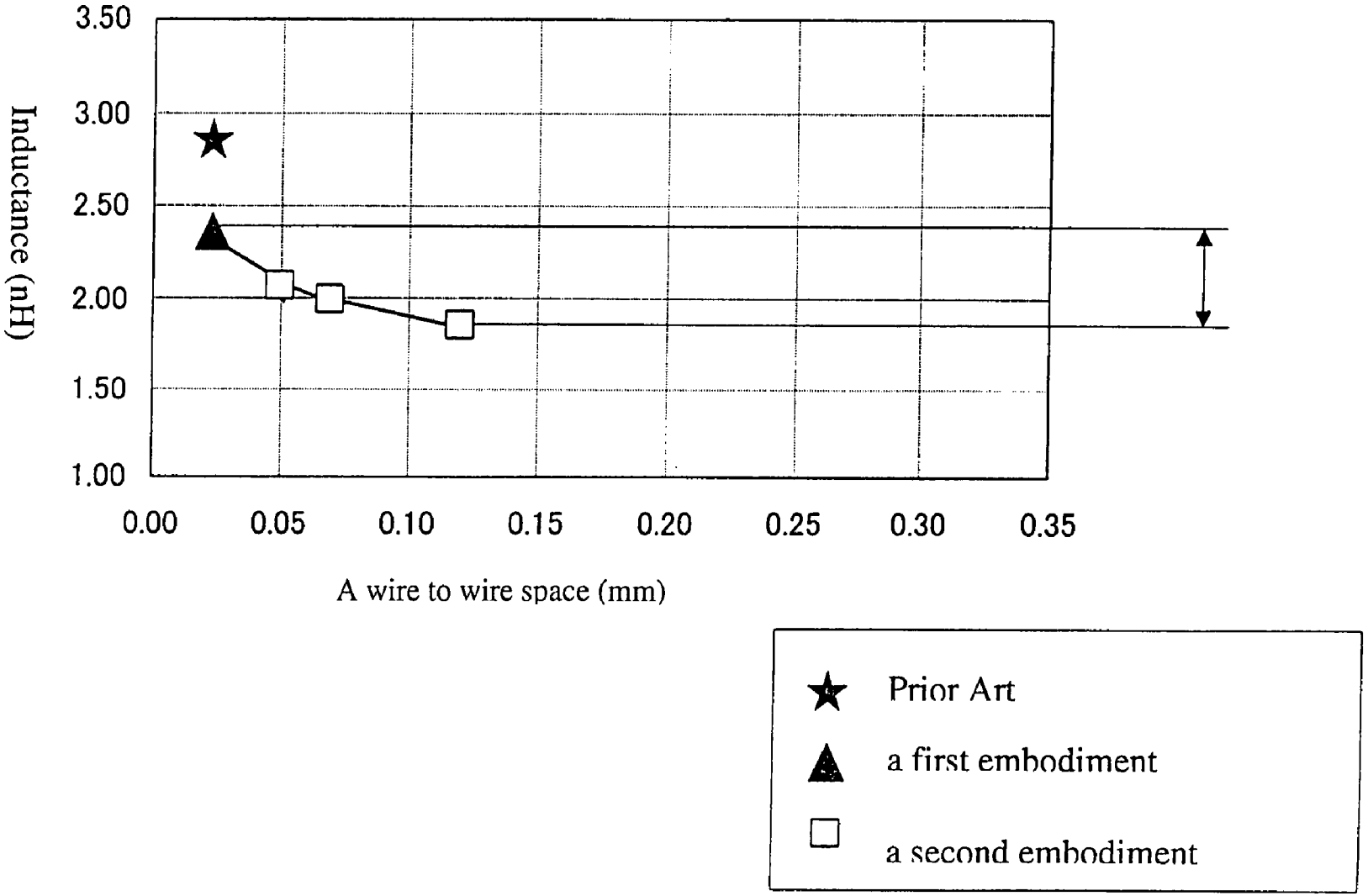
FIG. 7 is a graph showing the inductance of the wire-wound type chip coil as a function of the wire-to-wire space.

FIG. 7 shows the inductance as a function of the wire-to-wire space, for a two-turn coil of conductive wires with a diameter of approximately 50 μm. As shown, an inductance of about 2.2 nH is obtained for a wire-to-wire space of approximately 50 μm, an inductance of about 2.0 nH for a wire-to-wire space of approximately 70 μm, and an inductance of about 1.8 nH for a wire-to-wire space of approximately 120 μm. Thus, low inductance in E12 and E24 series can be achieved.

A wire-wound type chip coil according to a third preferred embodiment is described below with reference to FIGS. 8 and 9.

Figure 8:
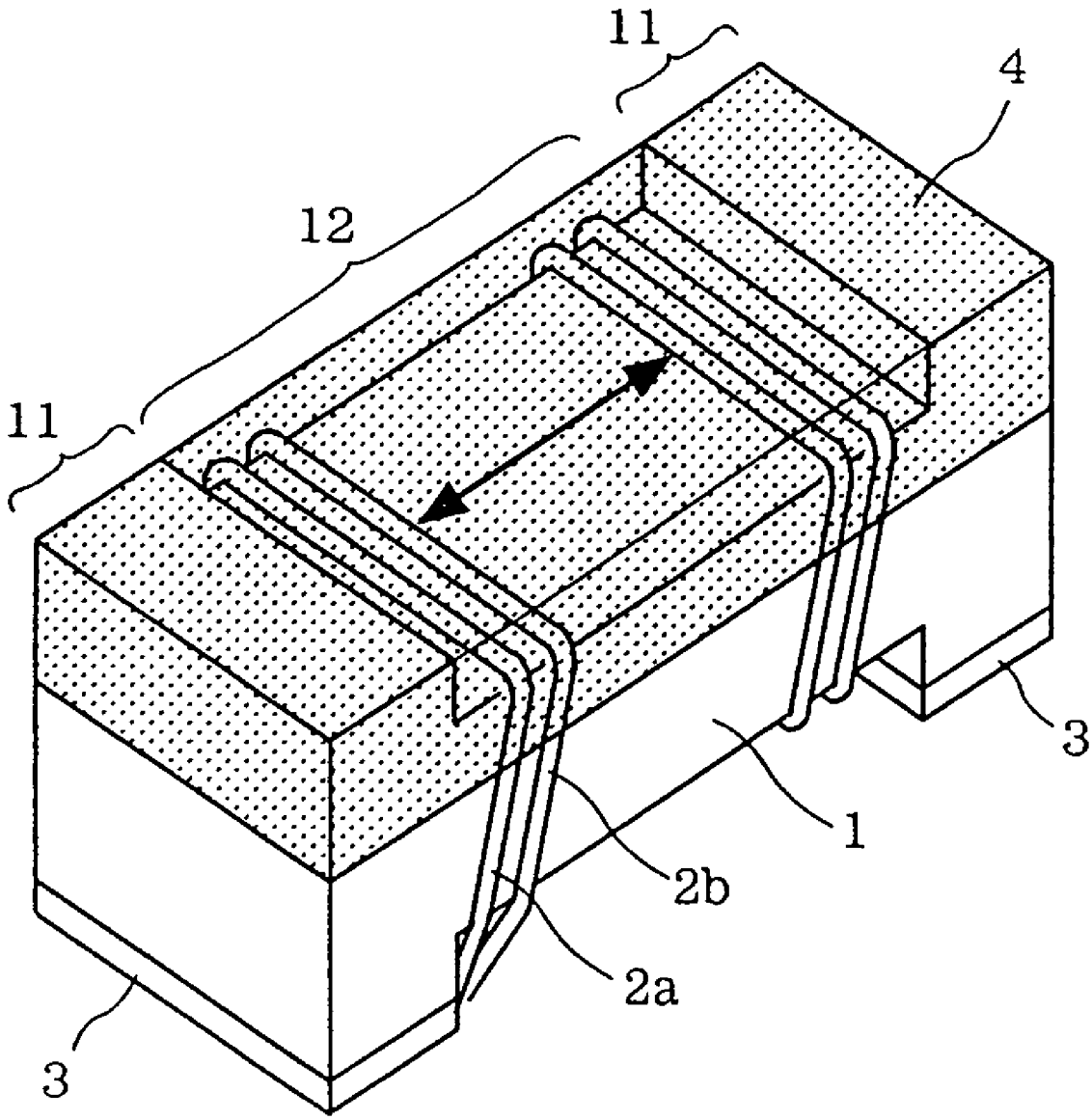
FIG. 8 is a perspective view illustrating the external appearance of a wire-wound type chip coil according to a third preferred embodiment of the present invention.

FIG. 8 is a perspective view illustrating the external appearance of the wire-wound type chip coil. In FIG. 8, reference numeral 1 denotes a core, 11 denotes a flange disposed on each end of the core, 12 denotes a main portion of the core, and 2*a* and 2*b* denote conductive wires wound around the main portion 12 of the core. The two ends of each of the two conductive wires 2*a* and 2*b* are connected to terminal electrodes 3 in a similar manner as in the first preferred embodiment of the present invention. Reference numeral 4 denotes a coating resin disposed on one principal surface of the core 1 around which the conductive wires 2*a* and 2*b* are wound.

In this preferred embodiment, unlike the wire-wound type chip coil according to the second preferred embodiment, two conductive wires 2*a* and 2*b* are regularly wound in a single layer around the main portion 12 of the core, and the space between one of the two conductive wires at a certain turn and the other one of the two conductive wires at an adjacent turn is adjusted so as to obtain a desired value of inductance. In the table shown in FIG. 11, in a row denoted by "THIRD EMBODIMENT", shown are values of inductance obtained by winding two conductive wires with a diameter of about 50 μm around a 1005-size core. As can be seen, inductance of about 2.0 nH to about 2.4 nH is obtained by a by a two-turn coil of two wires.

Figure 9:
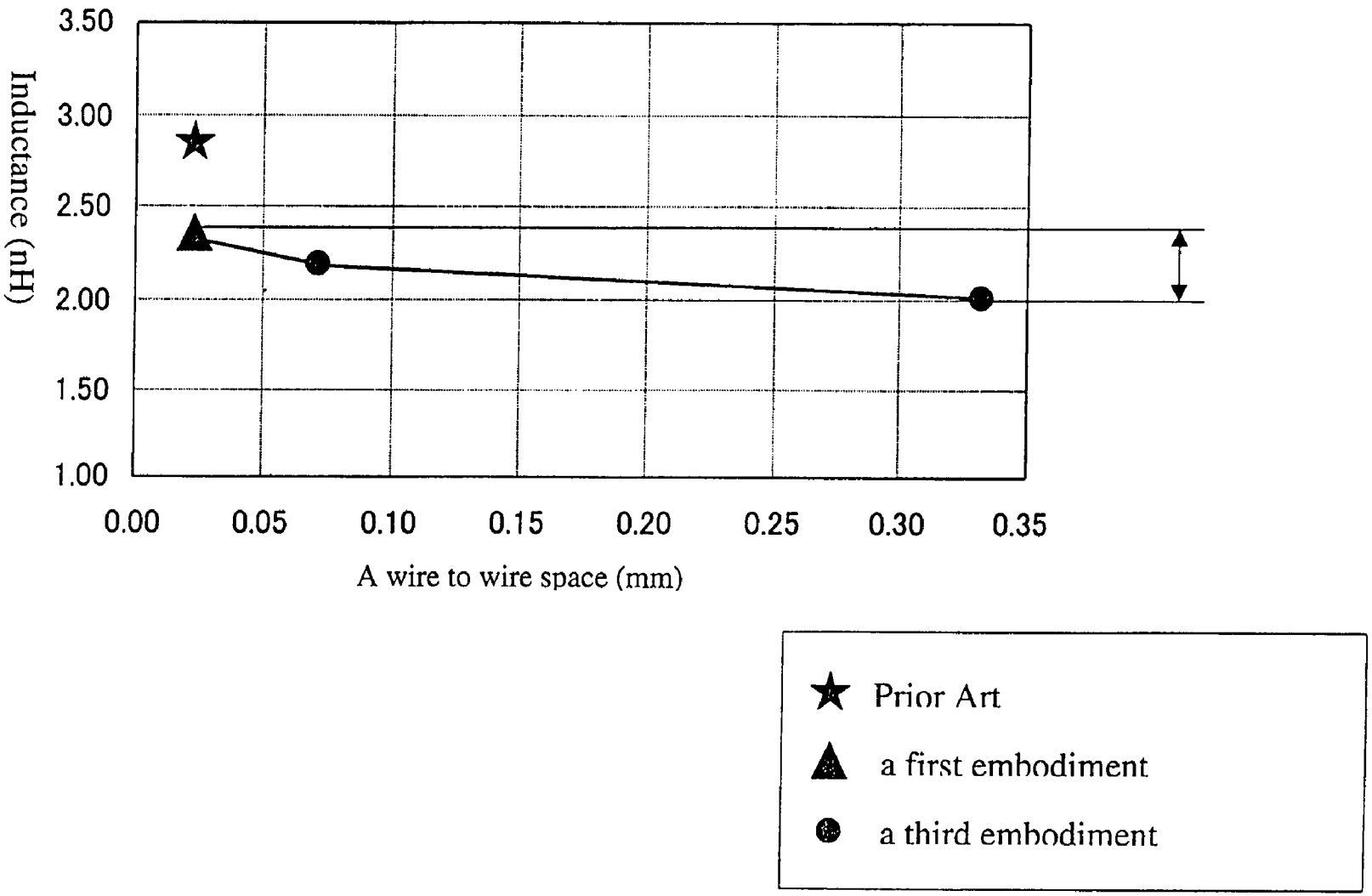
FIG. 9 is a graph showing the inductance of the wire-wound type chip coil as a function of the wire-to-wire space.

FIG. 9 shows the inductance as a function of the space between the two conductive wires, for a two-turn coil using conductive wires with a diameter of about 50 μm. Inductance of about 2.2 nH is obtained when the wire-to-wire space between adjacent turns is about 70 μm, and inductance of about 2.0 nH is obtained for a space of about 330 μm.

A method of adjusting a characteristic of a wire-wound type chip coil so as to obtain a desired inductance according to a fourth preferred embodiment is described below with reference to FIGS. 10A to 10C.

Figure 10B:
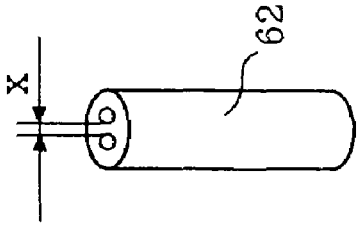
FIG. 10 is a diagram showing a process of winding conductive wires around a core according a fourth preferred embodiment of the present invention.
Figure 10C:
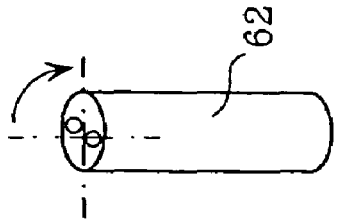
Figure 10A:
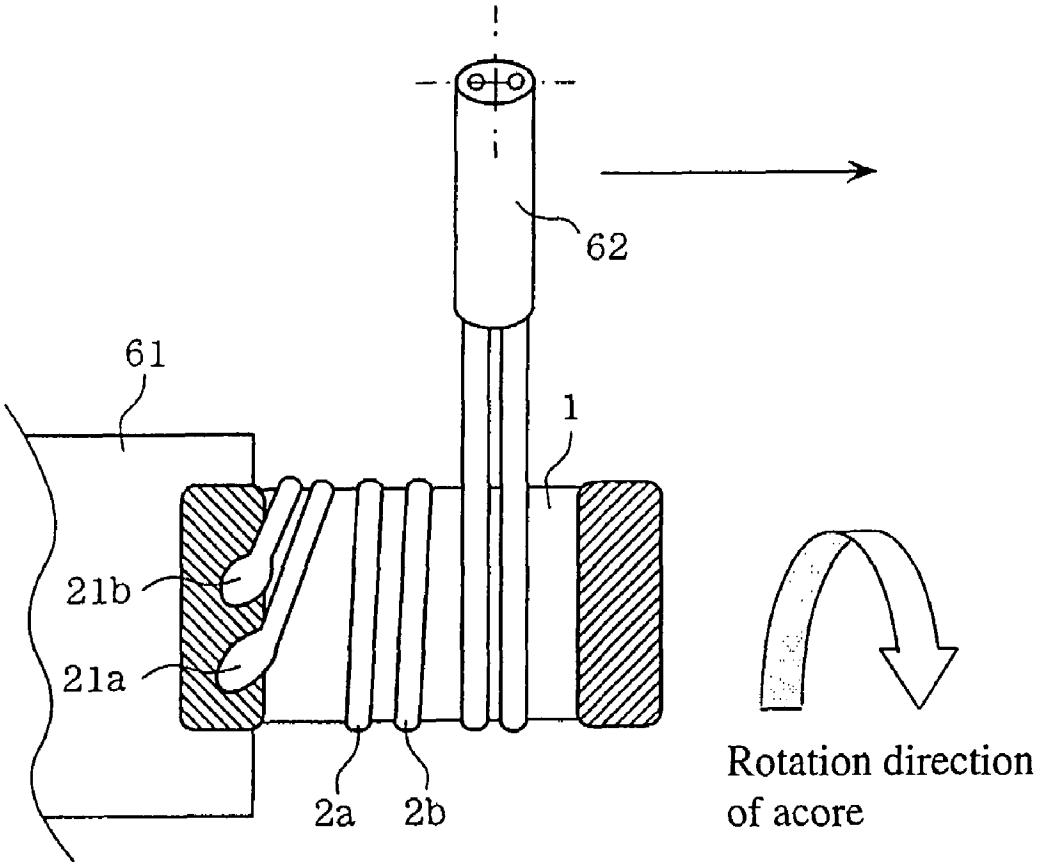
Figure 12:
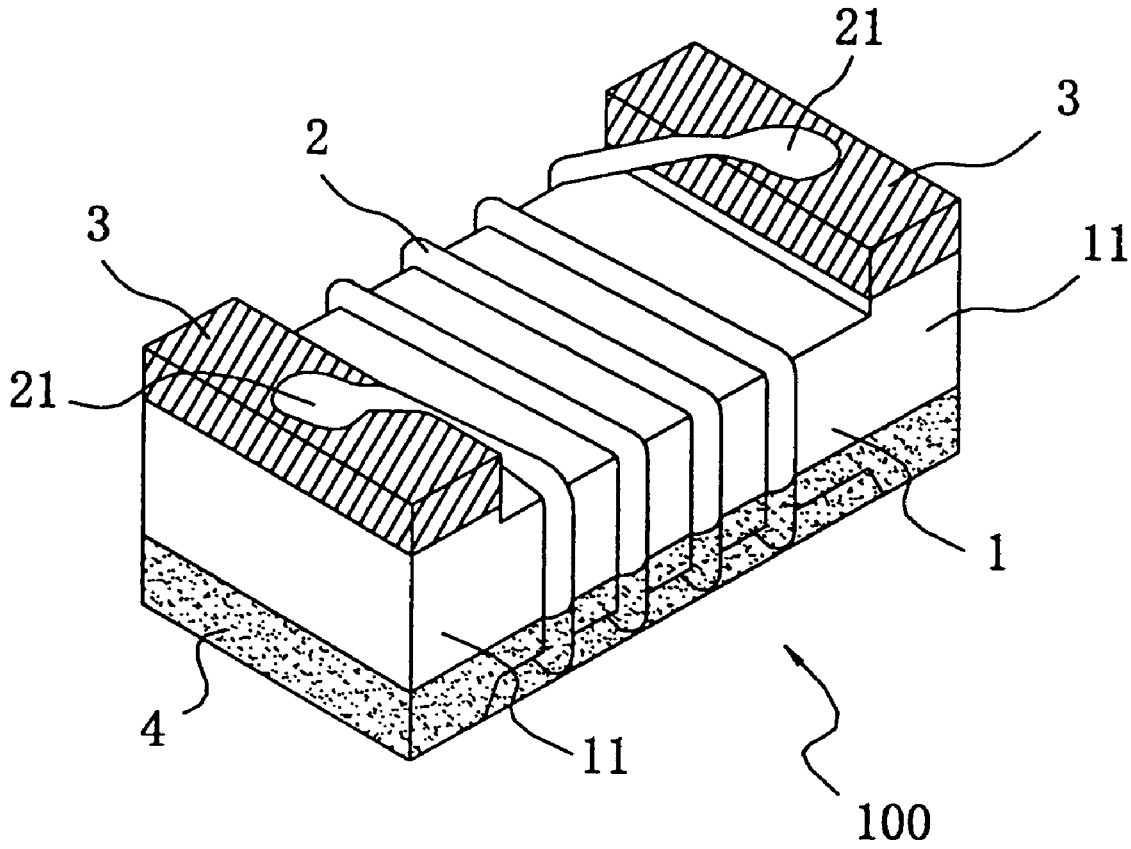
Fig. 12 PRIOR ART
FIG. 12 is a perspective view illustrating the external appearance of a wire-wound type chip coil according to a conventional technique.

FIG. 10A shows a process of winding the conductive wires 2*a* and 2*b* around the core 1. FIGS. 10B and 10C show winding nozzles 62.

In the example shown in FIG. 10B, two holes through which conductive wires are passed are formed in the winding nozzle 62 such that the space x between these two holes corresponds to the space between the two conductive wires 2*a* and 2*b*. A plurality of winding nozzles 62 having different spaces x are prepared, and a proper winding nozzle 62 is selected to obtain desired inductance using the same core 11.

In the example shown in FIG. 10C, the space between two conductive wires 2*a* and 2*b* is changed by rotating the winding nozzle 62 by a proper angle, i.e., approximately 45°, about the central axis extending in the longitudinal direction of the winding nozzle 62, and two conductive wires 2*a* and 2*b* are extracted from the winding nozzle 62 at the resultant angle. By rotating the winding nozzle 62, it is possible to reduce the space between the two conductive wires 2*a* and 2*b* wound around the core 1. This makes it possible to adjust the inductance to a desired value without having to replace the winding nozzle 62. This method can be used to produce a wire-wound type chip coil having the structure according to the second preferred embodiment of the present invention.

When the winding nozzle 62 is linearly moved in a direction denoted by an arrow in FIG. 10A while rotating the core 1 by chuck 61, the space from the two conductive wires 2*a* and 2*b* at a certain turn to the two conductive wires 2*a* and 2*b* at an adjacent turn can be determined by properly controlling the moving speed of the winding nozzle 62. This method can be used to produce a wire-wound type chip coil having the structure according to the third preferred embodiment of the present invention. Because, the space between the two terminal electrodes is fixed, it is required to change the moving speed of the winding nozzle 62 during a period from a start of winding the wires to an end of winding the wires. This makes it possible to adjust the space between conductive wires to a desired value while maintaining the two ends of each of the conductive wires 2*a* and 2*b* at fixed locations.

As can be seen from the above description, preferred embodiments of the present invention provide great advantages. That is, in preferred embodiments of the present invention, by using at least two conductive wires, it is possible to realize a wire-wound type chip coil which can take a greater number of different inductance values than can be achieved by the conventional technique, while maintaining its outer dimension at the same specified value. Furthermore, the Q value of the wire-wound type chip coil is greatly increased and the resistance thereof is greatly reduced, and thus, the loss of a matching circuit is greatly reduced.

Furthermore, in preferred embodiments of the present invention, by winding a plurality of conductive wires regularly in a single layer around a core, it is possible to form a wire-wound type chip coil having a very simple structure, which can take a greater number of different inductance values than can be achieved by the conventional technique, while maintaining its outer dimension at the same specified value.

Furthermore, in preferred embodiments of the present invention, by twisting two or more conductive wires into the form of a single strand, it is possible to obtain an even greater number of different values of inductance.

Furthermore, in preferred embodiments of the present invention, by winding two or more conductive wires around a core such that the two or more conductive wires are spaced from each other, it is possible to obtain an inductance value which is different from that obtainable by using one conductive wire and also different from that obtainable by the single-layer regular-winding structure.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A method of adjusting a characteristic of a wire-wound type chip coil comprising the step of:

providing a wire-wound type chip coil including a core, flanges each having only one terminal electrode respectively disposed on both ends of the core, at least two conductive wires wound around the core, one end of each of the at least two conductive wires being electrically connected to the only one terminal electrode on one of the flanges in parallel, and another end of each of the at least two conductive wires being electrically connected to the only one terminal electrode on another of the flanges in parallel; and adjusting the space between one of the at least two conductive wires wound around the core and another one of the at least two conductive wires wound around the core so as to adjust the inductance between the terminal electrodes.

2. A method according to claim 1, wherein the step of adjusting the space between adjacent ones of the at least two conductive wires wound around the core includes the step of rotating a winding nozzle by a predetermined angle about a central axis thereof such that the at least two conductive wires are extracted from the winding nozzle at a predetermined angle.

3. A method according to claim 1, wherein said at least two conductive wires are electrically connected to the respective terminal electrodes in parallel and wound regularly in a single layer around the core.

4. A method according to claim 1, wherein said at least two conductive wires are electrically connected to the respective terminal electrodes in parallel and are twisted together to form of a single strand, and the single strand of twisted conductive wires is wound around the core.

5. A method according to claim 1, wherein said at least two conductive wires are electrically connected to the respective terminal electrodes in parallel and are wound around the core such that said at least two conductive wires are spaced from each other.

6. A method according to claim 1, further comprising a coating resin disposed on an exterior of the core so as to cover the at least two conductive wires wound around the core.

7. A method according to claim 1, wherein the core is made of a material having a relative magnetic permeability of about 1.

8. A method according to claim 1, wherein the terminal electrodes have a thickness of about 10 μm to about 30 μm.

9. A method according to claim 1, wherein the diameters of the at least two conductive wires are preferably within the range of about 20 μm to about 120 μm.

10. A method according to claim 1, wherein the diameters of the at least two conductive wires are different from each other.

* * * * *